United States Patent [19]

Clemens

[11] 4,025,241

[45] May 24, 1977

[54] PERISTALTIC PUMP WITH TUBE PINCHING MEMBERS CAPABLE OF BIASING THE TUBING AWAY FROM THE PUMP ROLLERS

[75] Inventor: Anton Hubert Clemens, Elkhart, Ind.

[73] Assignee: Miles Laboratories, Inc., Elkhart, Ind.

[22] Filed: Dec. 22, 1975

[21] Appl. No.: 643,015

[52] U.S. Cl. ..... 417/477; 417/474

[51] Int. Cl.[2] ..... F04B 43/08; F04B 43/12; F04B 45/06

[58] Field of Search ..... 417/477, 476, 475, 474; 222/214

[56] References Cited

UNITED STATES PATENTS

| | | | |
|---|---|---|---|
| 2,695,567 | 11/1954 | Harvey | 417/475 |
| 2,877,714 | 3/1959 | Sorg et al. | 417/475 |
| 3,227,091 | 1/1966 | Isreeli et al. | 417/475 |
| 3,425,357 | 2/1969 | Bilichniansky et al. | 417/477 |
| 3,542,491 | 5/1969 | Newman | 417/477 |
| 3,730,650 | 5/1973 | Kling | 417/475 |
| 3,918,854 | 11/1975 | Catarious et al. | 417/477 |

*Primary Examiner*—Carlton R. Croyle
*Assistant Examiner*—Thomas I. Ross
*Attorney, Agent, or Firm*—Louis E. Davidson

[57] ABSTRACT

An improved peristaltic pump is described wherein the basic configurations of movable pump rollers, a base member and pump tubing compressed by the pump rollers against the spring loaded movable base member is improved by the addition of at least one actuating member capable of movement toward and away from an actuating position with respect to the base member. When the actuating members move toward their actuating positions, they compress the pump tubing against the base member and prevent fluid flow along the pump tubing. During such movement the actuating members also contact the base member and push it away from the pump rollers toward a non-pumping position so that movement of the pump rollers is no longer effective to cause pumping fluid along the pump tubing. When the actuating members are retracted from their actuating positions they allow the pump tubing to open for fluid flow therealong and allow the base member to return to a pumping position. A multiple channel pump assembly is also described.

19 Claims, 9 Drawing Figures

PERISTALTIC PUMP WITH TUBE PINCHING MEMBERS CAPABLE OF BIASING THE TUBING AWAY FROM THE PUMP ROLLERS

BACKGROUND AND PRIOR ART

Peristaltac pumps are well known in the art. These pumps usually consist of a base member having at least a portion of a generally cylindrical surface, a rotatable shaft located coaxially along the axis of said cylindrical surface, and several rollers supported by said shaft and positioned for movements along a predetermined circular path near the cylindrical surface. In U.S. Pat. Nos. 3,289,233 and 3,447,478the base member is spring biased toward a pumping position and movable against said bias toward a non-pumping position. An elastically deformable tube having an inlet and outlet is positioned between the cylindrical surface of the base member and the rollers in such manner that when the base member is in pumping position the elastically deformable tube is deformably closed by the rollers whenever the rollers come in contact with the tube. As the shaft is rotated, the rollers move along the tube and create a peristaltic pumping action. The tube is anchored in at least one point along its length so as to prevent gross tube movement through the pump.

These prior art pumps had several disadvantages. First, the only way of stopping the pumping action was by moving the base member to non-pumping position, where possible, or by stopping the movement of the pumping rollers along the pump tubing. While movement of the base member to non-pumping position effectively stops the pumping action, it does not provide a positive shut off of fluid flow through the pump. Stopping the rollers creates a problem in a multiple channel pump, since the pump rollers are common to all channels and it may be desired to stop or start the pumping in one channel independent of the other channels. Second, the prior art pumps usually start the pumping action by starting the movement of the pump rollers, irrespective of their position along the pump tubing. This can cause an undesirable variation in fluid pumped in a given unit of time is especially undesirable when relatively small quantities of fluids are being pumped.

These disadvantages of prior art peristaltic pumps are overcome by the pump of the present invention.

SUMMARY OF THE INVENTION

In accordance with the present invention, an improved peristaltic pump is provided which comprises a base member having a pumping segment, said base member being biased toward a pumping position and movable against said bias toward a non-pumping position, a plurality of movable pump rollers, pump tubing positioned between the base member and the pump rollers, the pump rollers being capable of compressing the pump tubing against the pumping segment of the base member and moving sequentially along the pump tubing and along the base member to pump any fluid contained within the pump tubing along the pump tubing. Means is provided for moving the pump rollers along the pump tubing, and at least one and preferably a pair of actuating members in the form of first and second on-off push rods are capable of simultaneous movement toward and away from an actuating position with respect to the base member, the first push rod being located upstream of the pumping segment of the base member and the second push rod being located downstream of the pumping segment of the base member. Means is also provided for moving the push rods toward and away from its actuating position, and when the push rods move toward said position they compress the pump tubing against the base member and prevent fluid flow along the pump tubing. At the same time such movement of the push rods causes the latter to contact the base member and push it away from the pump rollers to a non-pumping position so that continued movement of the pump rollers no longer causes pumping of fluid along the pump tubing between the push rods. When the push rods are retracted from their actuating positions they allow the pump tubing to open for fluid flow therealong, and allow the base member simultaneously to return its pumping position so that movement of the pump rollers again effects a peristaltic pumping action.

DESCRIPTION OF THE INVENTION

Figure 1:
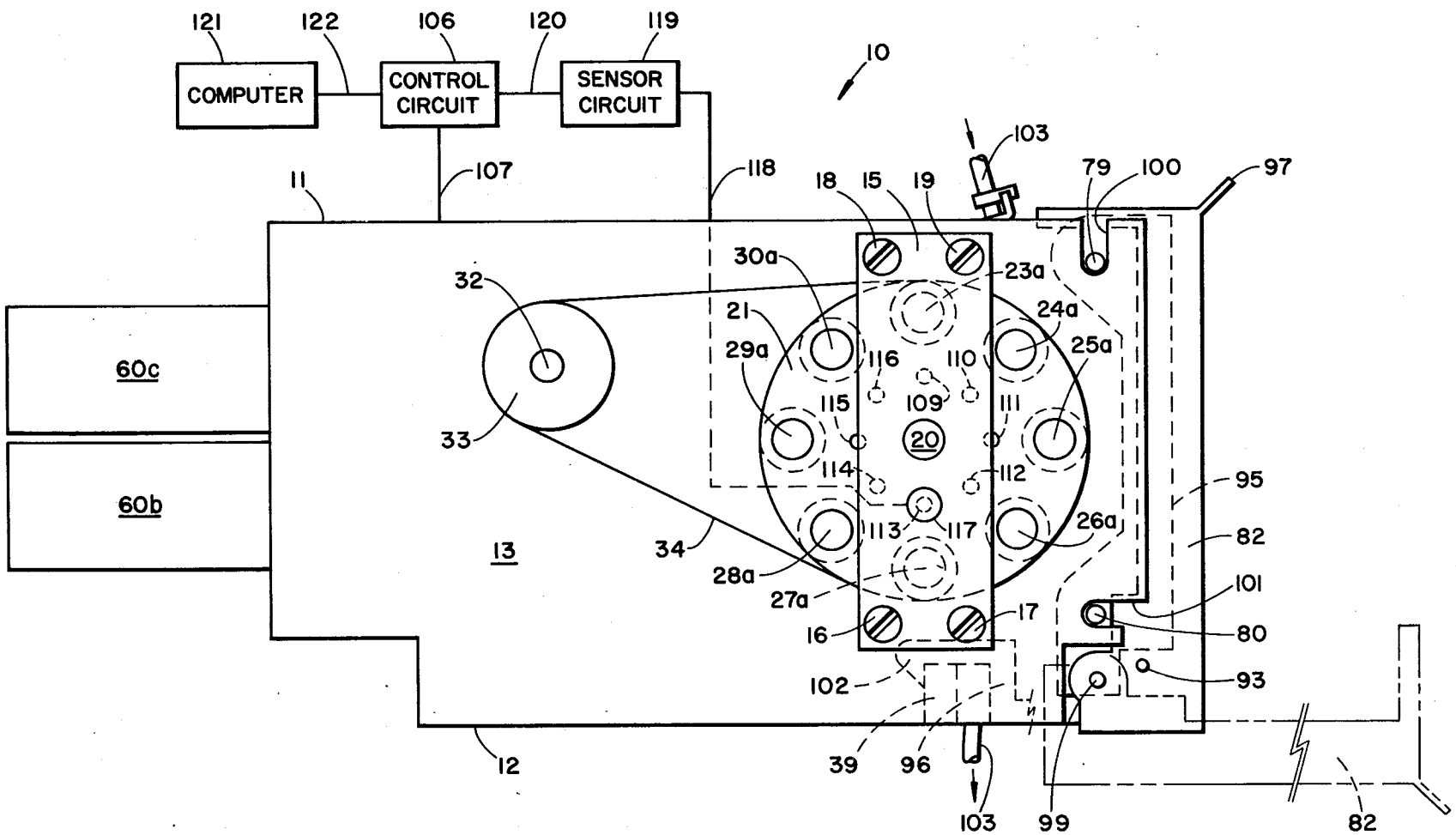
FIG. 1 is a side elevation of a peristaltic pump of the present invention with certain ancillary electrical circuits shown schematically in block diagram form.
Figure 2:
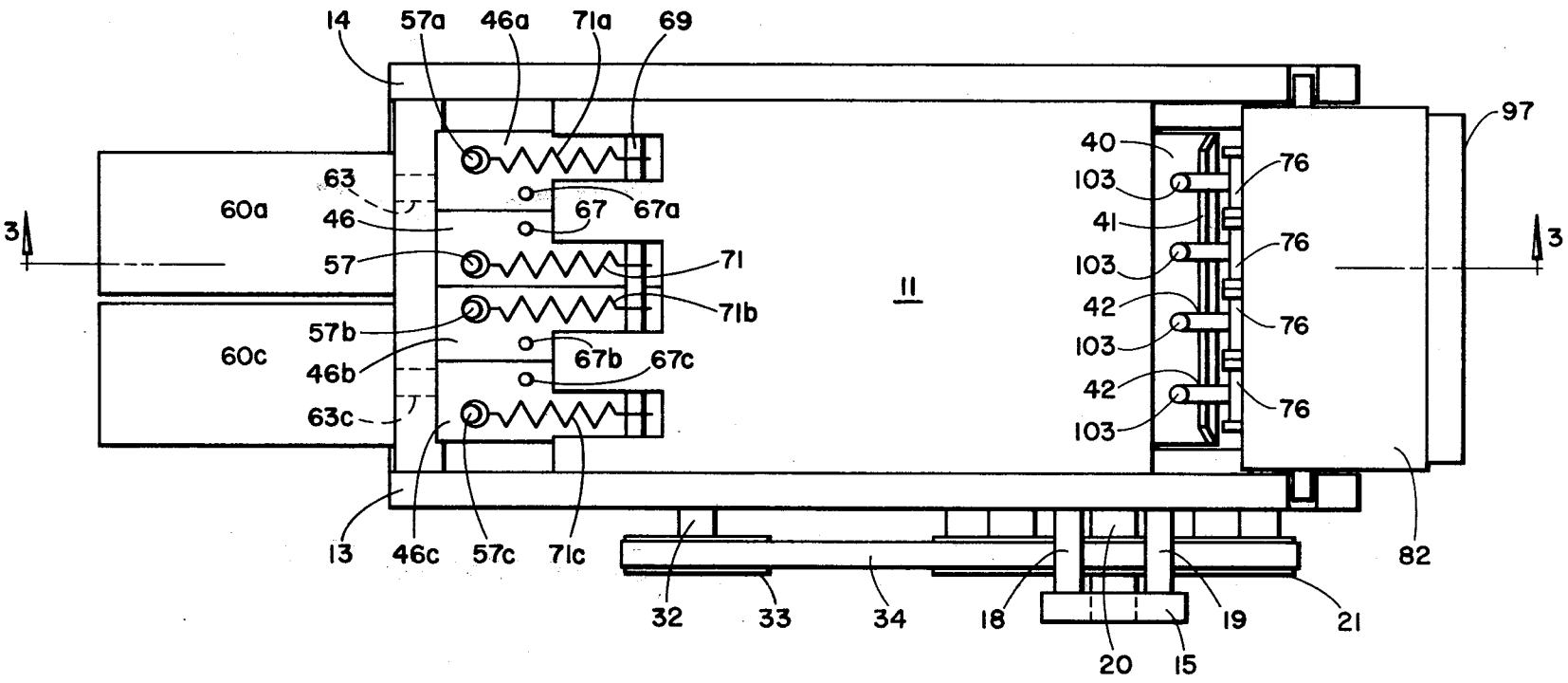
FIG. 2 is a plan view of the peristaltic pump of FIG. 1.
Figure 3:
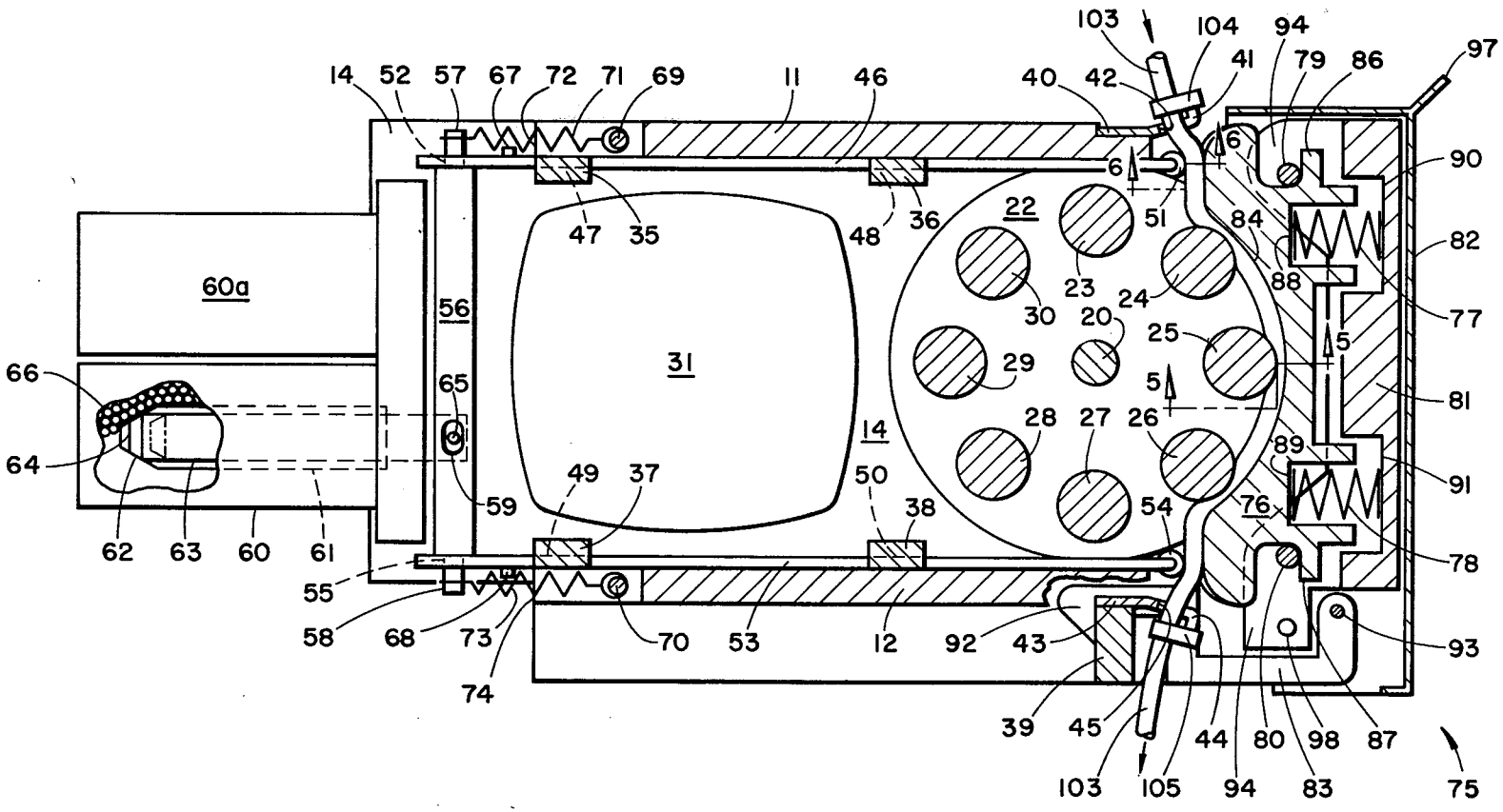
FIG. 3 is a vertical cross-sectional view of the peristaltic pump taken along line 3—3 of FIG. 2.

Referring to FIGS. 1 to 3, the novel pump 10 has a casing formed by top 11, bottom 12, and sides 13 and 14. An extension plate 15 is mounted by spacer bolts 16, 17, 18 and 19 to side 13. A rotatable pump roller shaft 20 is positioned across the pump 10 and is appropriately journaled into side 14 and extension plate 15. Circular end plates 21 and 22 are coaxially located on and near the ends of shaft 20. End plate 21 is located outside of side 13 while end plate 22 is located inside of side 14. A plurality of rotatable pump rollers 23, 24, 25, 26, 27, 28, 29 and 30 are spaced equiangularly around plates 21 and 22 and extended parallel to shaft 20 between end plates 21 and 22. Pump rollers 23–30 have reduced diameter end portions **23*a*–30*a* which are appropriately journaled into end plate 21 and reduced diameter end portions 23*b*–30*b*which are appropriately journaled into end plate 22**.

Motor and gearing means 31 are located in the casing and are connected to a rotatable shaft 32 which extends through and is journaled by side 13. A drive wheel 33 is mounted on the outer end of shaft 32. A belt or chain 34 passes around portions of the outer periphery of drive wheel 33 and circular end plate 21 and thus mechanically places drive wheel 33 in a driving position with respect to circular end plate 21.

Cross-members 35 and 36 located near top 11 extend between sides 13 and 14 and are supported thereby. Cross-members 35 and 36 have slots 47 and 48, respectively, therein. Cross-members 37, 38 and 39 located near bottom 12 extend between sides 13 and 14 and are supported thereby. Cross-members 37 and 38 have slots 49 and 50, respectively, therein. Tube support member 40 having an upturned lip 41 and slots 42 therein is supported by top 11 near one end thereof. Tube support members 43 having a downturned lip 44 and slots 45 therein is supported by cross-members 39.

A first upper on-off actuating member or push rod 46 has a rounded push member 51 located at one end thereof. Push rod 46 has a transverse passage 52 therethrough located near the other end thereof. Pin 67 is also located on push rod 46. Push rod 46 is movably positioned in the slots 47 and 48 of cross-members 35 and 36 and is supported and guided thereby. A second lower on-off actuating member or push rod 53 has a rounded 54 located at one end thereof. Push rod 53 has a transverse passage 55 therethrough located near the other end thereof. Pin 68 is also located on push rod 53. Push rod 53 is movably positioned in the slots 49 and 50 of cross-member 37 and 38 and is supported and guided thereby. Elongated member 56 having reduced diameter end portions 57 and 58 is located near the ends of push rods 46 and 53 with the end portions 57 and 58 extending through passages 52 and 55, respectively, of push rods 46 and 53. Member 56 also has a transverse slotted passage 59 therethrough. A top rod 59 therethrough. A top rod 69 and a bottom rod 70 extend between sides 13 and 14 are supported thereby. A tension spring 71 extends between end portion 57 and top rod 69 and biases push rod 46 toward its actuating position wherein in 67 abuts against end edge 72 of top 11. A spring 73 extends between end portion 58 and bottom rod 70 and biases push rod 53 toward its actuating position wherein pin 68 abuts against end edge 74 of bottom 12.

A solenoid 60 having a passage 61 longitudinally therein is positioned near member 56. Passage 61 has a frustoconical portion 62 at the internal end thereof. Magnetic shaft 63 having a frustoconical portion 64 at one end and a pin 65 at the other end is positioned in passage 61 with the pin 65 located in passage 59 of member 56. The wire winding 66 of solenoid surrounds passage 61.

A base member assembly 75 has a movable base member 76, compression springs 77 and 78, transverse rods 79 and 80, back member 81, cover 82, latch member 83 and 96 and sides 94 and 95. Base members 76 has a flat concave pumping segment surface 84 having edge ridges 85 (shown in FIG. 5) therealong. Base member 76 also has an upper abutment 86 and a lower abutment 87 as well as depressions 88 and 89 therein. Back member 81 has depressions 90 and 91 formed therein. Compression spring 77 is located in and between depression 88 of base member 76 and depression 90 of back member 81. Compression spring 78 is located in and between depression 89 of base member 76 and depression 91 of back member 81. These compression springs bias the base member 76 toward the pump rollers to a pumping position wherein abutments 86 and 87 of base member 76 abut against rods 79 and 80. Rods 79 and 80 extend between and through sides 94 and 95. Latch member 83 having latch 92 is located near side 14 of the pump casing and pivots around rod 93. A companion latch member 96, partially shown in FIG. 1 is located along and near to side 13 of the pump casing. Latch member 96 also pivots around rod 93. Cover 82 having a handle 97 is pivotally supported by a pin 98 in side 94 and pin 99 in side 95 of the base member assembly.

The first upper push rod 46 and its associated push member 51 are located upstream or above the pumping segment 84 of base member 76. The second lower push rod 53 and its associated push member 54 are located downstream or below the pumping segment 84 of base member 76.

Base member assembly 75 is removably attached to the casing of the pump 10. As shown in FIGS. 1 and 3, transverse rod 79 fits into slot 100 of side 13 and into a companion slot (not shown) of side 14. Transverse rod 80 fits into slot 101 of side 13 and into a companion slot (not shown) of side 14. Latches 92 and 102 of latch members 83 and 96, respectively, mate against and over cross-member 39. In order to remove the base member assembly from the pump, the cover 82 is grasped by the handle 97 and is pivoted to the lower position shown in phanthom in FIG. 1. This action lifts latched 92 and 102 above cross-member 39 and allows the cover to be pulled outward disengaging rod 80 from the slot 101 of side 13 and the companion slot of side 14. The base member assembly can then be lifted upward to disengage rod 79 from slot 100 of side and from the companion slot of side 14. The base member assembly can be reattached to the pump casing by a reversal of the above steps.

Pump tubing 103 having external abutments 104 and 105 is positioned between the pump rollers 23–30 and the base member 76. Tubing 103 is placed in slot 42 of tube support 40 with abutment 104 placed over lip 41. Tubing 103 is also placed in slot 45 of tube support 43 with abutment 105 placed over lip 44. The combination of abutments 104 and 105 with lips 41 and 44 prevents longitudinal movement of tubing 103.

The above description relates to a single combination of tubing 103 and base member 76 to be used with the pump rollers 23–30. The pump apparatus shown in plan view in FIG. 2 is basically four separate pumps in side-by-side relation each having a pump tubing 103 and an associated base member 76. The corresponding pump rollers 23–30 of each pump are coaxially joined to respectively form a unitary elongated roller common to all of the pumps. When a plurality of pumps are employed to form a multiple channel pump assembly, each pump has a corresponding pair of push rods, such as 46 and 53, with the associated member 56, springs 71 and 73 and solenoid 60. As shown in FIGS. 1, 2 and 3 corresponding elements for the other pumps have the same identification number with the appropriate suffix "a", "b" and "c".

Figure 6:
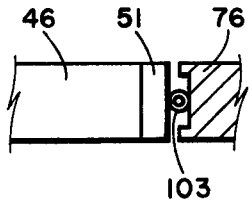
FIG 6 is a horizontal cross-sectional view of a portion of the pump taken along line 6—6 of FIG. 3.

A control circuit 106 having associated power supplies and switches shown in block diagram in FIG. 1 is connected by line 107 to the motor and gearing means 31 and to the solenoids 60, 60*a*, 60*b*and 60*c*. In order to operate the pump apparatus 10, a supply of fluid to be pumped (not shown) is connected to the pump tubing 103 so that fluid enters the upper end of the tubing. The control circuit 106 is then activated in an "ON" mode. Motor and gearing means 31 turns shaft 32 in a clockwise direction, as viewed in FIG. 1, so that end plates 21 and 22 are then rotated about shaft 20 in a clockwise direction. The appropriate solenoid 60 is activated so as to cause shaft 63 to move to the left, as shown in FIG. 3, and abut against the frustoconical section of passage 61. This moves member 56 to the left and pulls push rods 46 and 53 simultaneously away from base member76 against the action springs 71 and 73 to the retracted position shown in FIG. 3 in which push members 51 and 54 do not apply pressure to tubing 103 and therefore allow fluid to flow through tubing 103. This is shown in cross-section in FIG. 6.

Figure 5:
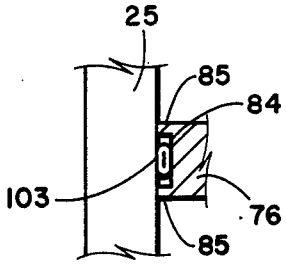
FIG. 5 is a horizontal cross-sectional view of a portion of the pump taken along line 5—5 of FIG. 3.

The compression springs 77 and 78 thereupon force base member 76 to the left to its pumping position so that tubing 103 is compressed between the pump rollers and the pumping segment 84 of base member 76 as shown in cross-section in FIG. 5. The edge ridges 85 of base member 76 abut against the pump roller, such as pump roller 25, to prevent excessive compression of tubing 103. As the pump rollers 23–30 rotate around shaft 20, they successively come into compressive contact with tubing 103 and move fluid along tubing 103 in the portions of tubing 103 between adjacent pump rollers.

Figure 4:
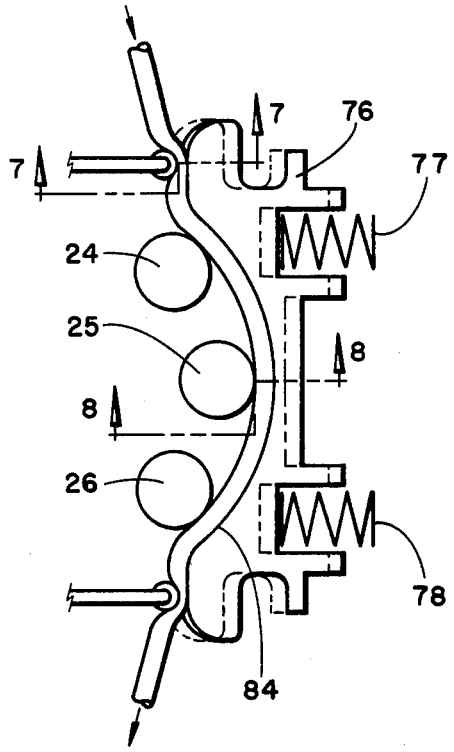
FIG. 4 is vertical cross-sectional view similar to that of FIG. 3 of a portion of the pump in an operational mode different from that shown in FIG. 3.
Figure 7:
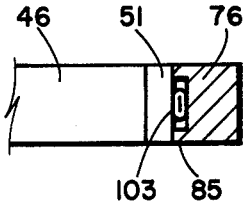
FIG 7 is a horizontal view of a portion of the pump taken along line 7—7 of FIG. 4.
Figure 8:
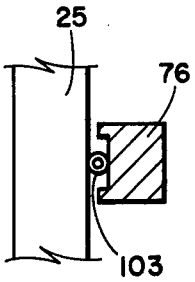
FIG. 8 is a horizontal view of a portion of the pump taken along line 8—8 of FIG. 4.

In order to stop the pumping action, the control circuit 106 is activated to an "OFF" mode for the specific pumping channel. The appropriate solenoid 60 is then deactivated. Springs 71 and 73 then cause the push rods 46 and 53 to move to the right to their actuated positions wherein the pins 67 and 68 abut against edges 72 and 74, respectively, and at the same time shaft 63 is pulled to the position shown in dotted lines in FIG. 3. Push members 51 and 54 are now pressed against tubing 103 to achieve the compressed relationship shown in cross-section in FIG. 7. The edge ridges 85 of base member 76 prevent excessive compression of tubing 103. The springs 71 and 73 in so moving the push rods 46 and 53 overpowers the compression springs 77 and 78 and moves base member 76 from the dotted pumping position shown in FIG. 4 to the solid non-pumping position shown in FIG. 4 wherein the pumping segment 84 if base member 76 is out of pumping relationship with the pump rollers. This is shown in cross-section in FIG. 8. This latter relationship is especially important in a multiple channel pump in which one or more channels are in pumping operation and one or more channels are not in a pumping operation. The push rods positively close-off the tubing to fluid flow and the pump rollers are ineffective to move fluid along the tubing between the push rods.

Figure 9:
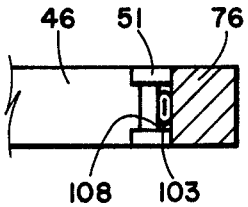
FIG. 9 is a horizontal view of a portion of the pump similar to that of FIG. 7 showing a preferred form of the end of the push rods and the corresponding portion of the base member.

In a preferred form of the pump apparatus the rounded push members 51 and 54 have a groove 108 therein into which the tubing 103 is placed. This is shown in FIG. 9. When the push rod 46 is in the "OFF" mode, the push member 51 mates against base member 76 while compressing tubing 103. In this apparatus modification, the portions of base member 76 adjacent to push members 51 and 54 do not have the edge ridges 85. The depth of the groove 108 in push member 51 is predetermined to properly compress tubing 103 while also preventing excessive compression thereof.

In another preferred form of the apparatus, edge plate 21 has a series of depressions 109–116 located on the outer surface thereof and spaced equiangularly around shaft 20. Each depression 109–116 is located on the same radial line from shaft 20 as are the pump rollers 23–30. A sensor means 117, such as a combination light emitting diode and a photosensor, is mounted through and supported by extension plate 15. Sensor means 117 is connected through line 118 to sensor circuit 119 shown in block diagram in FIG. 1 which in turn is connected through line 120 to control circuit 106. Under usual operating conditions the light emitting diode portion of sensor means 117 emits light which is reflected from the outer surface of edge plate 21 and is detected by the photosensor. When a depression 109–116 passes beneath the sensor means 117, the reflected light is sharply reduces causing a change in signal produced by the photosensor. In order to insure that the pumping operation of any given pumping channel always starts with the pump rollers in a specific position, the control circuit is so programmed as to not allow the solenoid 60 to be activated by the control circuit 106 to retract the push rods 46 and 53 from their actuating positions until the sensor means 117 has a signal change caused by a depression 109–116 passing therebeneath. This will guarantee that the base member 76 cannot move to its pumping position and that pumping action of any given channel therefore cannot start until the pump rollers are in the predetermined positions along the pump tubing shown in FIGS. 1 and 3. It is understood that other forms of sensor means can be employed for this same purpose.

In a further preferred form of the apparatus, a computer 121, shown in block diagram in FIG. 1, is connected by line 122 to control circuit 106. The computer output can program the operation of the pump so as to start and stop each individual pumping channel depending on a predetermined operating cycle or depending on specific variable inputs to the computer 121. The control circuit 106 may also be programed so as to allow manual override of any signals from the computer 121.

While preferred form of the improved pump utilizes a rectilinearly movable base member 76 and a pair of actuating members of push rods 46 and 53, it will be obvious to those skilled in the art that the base member may, if desired, be mounted for pivotal movement, as in U.S. Pat. No. 3,447,478, and that when such base member mounting is used, a single actuating member or push rod can be used, rather than two.

It will also be apparent to those skilled in the art that, while in the preferred form of the improved pump the pump rollers are moved in a circular path and the base member segment is correspondingly concave, the invention is equally applicable to those pump structures in which the pump roller path takes another shape. For example, the pump rollers may be carried by endless chains and caused to be moved in a predetermined straight line path parallel to a base member segment which is essentially planar, the latter pump structure being well known in the art.

Various other changes and modifications may be made in the illustrated embodiment without departing from the spirit of the invention, and all of such changes are contemplated as may come within the scope of the appended claims.

What is claimed is:

1. In a peristaltic pump comprising a base member, means for biasing said base member toward a pumping position, a plurality of spaced pump rollers mounted for movement along a predetermined path, and pumping tubing compressed between said base member and said pump rollers when said base member is in its pumping position such that movement of said pump rollers along said predetermined path effects peristaltic pumping of any fluid within said pump tubing, movement of said base member to a non-pumping position being effective to release said compression of said pump tubing such that continued movement of said pump rollers along said path is ineffective to produce said peristaltic pumping action, the improvement which comprises at least one actuating member cooperable with said pump tubing and base member and mounted for movement from a retracted position wherein it is substantially out of compressive contact with said pump tubing against the bias of said biasing means toward an actuating position in which said pump tubing is compressed between said actuating and base members such that fluid flow through said tubing is prevented and said base member is held thereby in a non-pumping position.

2. A peristaltic pump according to claim 1 wherein there are two actuating members mounted for simultaneous movement.

3. A peristaltic pump according to claim 1 wherein said base member has a pump segment against which said pumping tubing is pressed when said base member is in its said pumping position, and there are two actuating members mounted for simultaneous movement, one of said actuating members being located upstream of said pumping segment of said base member and the other being located downstream thereof.

4. A peristaltic pump as in claim 1 wherein there is means for biasing said at least one actuating member toward said actuating position.

5. A peristaltic pump as in claim 4 wherein there is first means providing said biasing of said base member toward its said pumping position and there is second means for biasing said at least one actuating member toward said actuating position, said second biasing means being sufficiently strong to overcome the bias of said first biasing means.

6. A peristaltic pump as in claim 1 wherein there is means associated with said member for preventing excessive compression of said pump tubing by said pump rollers.

7. A peristaltic pump as in claim 1 wherein there is means associated with said at least one actuating member for preventing excessive compression of said pump tubing by said at least on actuating member.

8. A peristaltic pump as in claim 1 wherein there is means associated with said pump rollers and said at least one actuating member for preventing movement of the latter from said actuating position toward said retracted position unless said pump rollers are in a predetermined location along said pump tubing.

9. A peristaltic pump as in claim 1 wherein there is means for moving said pump rollers along said predetermined path, means for moving said at least one actuating member between said retracted and actuating position, and control circuit means for controlling the operation of said pump roller moving means and said means for moving said at least one actuating member.

10. A peristaltic pump as in claim 9 wherein there is sensor means associated with said pump rollers and said control circuit means for preventing movement of said at least one actuating member from said actuating position toward said retracted position unless said pump rollers are in a predetermined location along said pump tubing.

11. In a combination a peristaltic pump as in claim 9 and a computer connected to said control circuit means of said pump, said control circuit means being responsive to signals received from said computer.

12. In a peristaltic pump comprising a base member, said base member having a pumping segment and being mounted for rectilinear movement between a pumping position and a non-pumping position, spring means for biasing said base member toward its said pumping position, a plurality of spaced pump rollers mounted for movement along a predetermined path, means for moving said pump rollers along said path, and pump tubing compressed between the pumping segment of said base member and said pump rollers when said base member is in its said pumping position such that movement of said pump rollers along said predetermined path effects peristaltic pumping of any fluid within said pump tubing, movement of said base member to its said non-pumping position being effective to release said compression of said pump tubing such that continued movement of said pump rollers along said path is ineffective to produce said peristaltic pumping action, the improvement which comprises first and secondactuating members cooperable with said pump tubing and base member and mounted for simultaneous movement from retracted positions wherein they are substantially out of compressive contact with said pump tubing against the bias of said spring means toward actuating positions in which said pump tubing is compressed between said actuating and base members such that fluid flow through said tubing is prevented and said base member is held thereby in its said non-pumping position, spring means biasing said actuating members toward said actuating positions and capable of overcoming the bias of said spring means associated with said base member, said first actuating member being located upstream of said pumping segment, and said second actuating member being located downstream of said pumping segment, and actuating means for moving said actuating members toward said retracted positions against the bias of the spring means associated therewith.

13. A peristaltic pump as in claim 12 wherein there is means associated with said base member for preventing excessive compression of said pump tubing by said pump rollers.

14. A peristaltic pump as in claim 12 wherein there is means associated with said actuating members for preventing excessive compression of said pump tubing by said actuating members.

15. A peristaltic pump as in claim 12 wherein said actuating means for moving said actuating members is solenoid means.

16. A peristaltic pump as in claim 12 wherein there is control circuit means for controlling the operation of said means for moving said pump rollers and of said actuating means for moving said actuating members.

17. A peristaltic pump as in claim 16 wherein there is sensor means associated with said pump rollers and said control circuit means for preventing movement of said actuating members from said actuating positions toward said retracted positions unless said pump rollers are in a predetermined location along said pump tubing.

18. A multiple channel pump assembly comprising in combination a plurality of peristaltic pumps as in claim 1 disposed is side-by-side relation, the corresponding pump roller of each of said pumps being coaxially joined to form a elongated roller common to all of said pumps.

19. A multiple channel pump assembly comprising in combination a plurality of peristaltic pumps as in claim 12 disposed in side-by-side relation, the corresponding pump rollers of each of said pumps being coaxially joined to form a elongated roller common to all of said pumps.

* * * * *

UNITED STATES PATENT OFFICE

CERTIFICATE OF CORRECTION

PATENT NO. : 4,025,241

DATED : May 24, 1977

INVENTOR(S) : Anton Hubert Clemens

It is certified that error appears in the above-identified patent and that said Letters Patent are hereby corrected as shown below:

| | |
|---|---|
| Column 1, Line 7, | Change "Peristaltac" to --Peristaltic--. |
| Column 3, Line 11, | Change "cross-members" to --cross-member--. |
| Column 3, Line 20, | After "rounded", insert --push member--. |
| Column 3, Lines 30-31, | Delete "A top rod 59 therethrough". |
| Column 3, Line 32, | After "14", insert --and--. |
| Column 3, Line 35, | After "wherein", change "in" to --pin--. |
| Column 3, Line 46, | After "solenoid", insert --60--. |
| Column 3, Line 51, | Change "ber" to --bers--. |
| Column 3, Line 51, | Before "76" change "members" to --member--. |
| Column 4, Line 23, | Change "latched" to --latches--. |
| Column 5, Line 37 | After "84", change "if" to --of--. |
| Column 6, Line 31 | After "While", insert --the--. |
| Column 6, Line 62, | Before "pumping" insert --said--. |

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*